US005810185A

United States Patent [19]

Groesbeck

[11] Patent Number: 5,810,185

[45] Date of Patent: Sep. 22, 1998

[54] RECLOSABLE BOTTLE CLOSURE FOR CARBONATED BEVERAGES AND THE LIKE

[76] Inventor: Robert Clay Groesbeck, 4206 Mt. Olympus Way, Salt Lake City, Utah 84124

[21] Appl. No.: 767,472

[22] Filed: Dec. 16, 1996

Related U.S. Application Data

[63] Continuation of Ser. No. 397,478, Mar. 2, 1995, abandoned.

[51] Int. Cl.[6] ..... B65D 47/04

[52] U.S. Cl. ..... 215/387; 215/313; 220/715; 222/499; 222/525

[58] Field of Search ..... 215/228, 311, 215/313, 387; 220/715, 256; 222/498, 499, 522, 525, 631

[56] References Cited

U.S. PATENT DOCUMENTS

| | | | |
|---|---|---|---|
| 2,886,219 | 5/1959 | Van Baarn | 222/499 X |
| 3,216,630 | 11/1965 | Stull | 222/499 |
| 3,305,127 | 2/1967 | Baranne | 222/499 X |
| 4,773,572 | 9/1988 | Stull | 222/521 |
| 5,285,933 | 2/1994 | Gentes et al. | 222/148 |
| 5,456,374 | 10/1995 | Beck | 215/251 |
| 5,472,120 | 12/1995 | Stebick et al. | 222/525 X |
| 5,588,562 | 12/1996 | Sander et al. | 222/153.06 |

*Primary Examiner*—Stephen Cronin
*Attorney, Agent, or Firm*—Mallinckrodt & Mallinckrodt

[57] ABSTRACT

Prior art bottle closures having a stationary closure member applicable to the top of a bottle and a closure member that is movable relative to the stationary closure member are improved by incorporation, between said closure members, of mutually cooperative, fluid sealing members extending transversely of the pouring axis of the bottle closures and separable therefrom for preventing escape of gaseous ingredients, such as carbonation, of drinkable liquids contained by bottles to which the bottle closures are applied.

10 Claims, 6 Drawing Sheets

RECLOSABLE BOTTLE CLOSURE FOR CARBONATED BEVERAGES AND THE LIKE

RELATED APPLICATION

The present application is a continuation of my application Ser. No. 08/397,478 filed Mar. 2, 1995, now abandoned.

BACKGROUND OF THE INVENTION

1. Field

This invention is in the field of bottle closures of the type that enables a bottle to be opened and then reclosed.

2. State of the Art

A popular bottle closure of the type concerned is extensively used on individual, consumer-sized bottles of drinking water to enable occasional opening of the bottle to permit drinking therefrom or the pouring out from the bottle of enough of the contained liquid to satisfy momentary thirst. The top is reclosable so that, after such an opening of the bottle, the top may be again closed to protect the contents. So far as I can ascertain, bottles of this type have never been used in the marketing of carbonated beverages, such as many soft drinks, or of various other beverages, such as beer, which quickly become stale after opening by reason of the loss of the carbonation or other gaseous constituent.

SUMMARY OF THE INVENTION

In accordance with the invention, I have conceived of modifying such bottle closures so that they can be used on bottles containing various soft drinks and other carbonated beverages, as well as beer and sparkling wines, to seal against loss of the gaseous content.

In following through on this concept, I have modified a typical, currently used type of bottle closure by providing sealing means about the circumferential opening or openings that results from displacing a movable closure member relative to a stationary, central, stopper post that is surrounded by such movable closure member and that is part of a stationary closure member on which the movable closure member slides. This is done by adding compressive sealing members to the movable closure members or to it and the stopper post, respectively, for exerting sealing pressure against respective coacting seats of the other closure member, when the bottle is reclosed following the opening thereof.

Both the compressive sealing members and the coactive seats extend transversely of the pouring axis of the container, and the sealing members are separable from other parts of the bottle closure.

THE DRAWINGS

The best mode presently contemplated for carrying out the invention in actual practice is illustrated in the accompanying drawings, in which:

FIG. 1 represents a pictorial view of the top portion of a typical bottle containing a carbonated beverage and openable and sealingly reclosable repeatedly by a preferred embodiment of the bottle closure of the invention;

FIG. 2, an exploded view of the bottle top and closure of FIG. 1;

FIG. 3, a view in vertical section taken on the line 3—3 of FIG. 1,;

FIG. 4, a view corresponding to that of FIG. 3 but with the protective top member of the closure removed and the movable member of the bottle closure unscrewed to open the bottle for drinking or pouring therefrom;

FIG. 5, a view corresponding to that of FIG. 4 but of a less desirable embodiment wherein the movable closure member is slidably mounted relative to the stationary central stopper part of the bottle closure as it is in the prior art rather than being mounted thereon by screw threads as in the embodiment of FIGS. 1–4;

FIG. 6, a view corresponding to that of FIG. 4 but showing alternative placement of the sealing member;

FIG. 7, a view corresponding to that of FIG. 6 but showing an alternative form of the sealing member itself; and FIG. 8, a view corresponding to that of FIG. 6, but using the alternative sealing member of FIG. 7 in the alternative position of FIG. 3.

DETAILED DESCRIPTION OF THE ILLUSTRATED EMBODIMENTS

Figure 4:
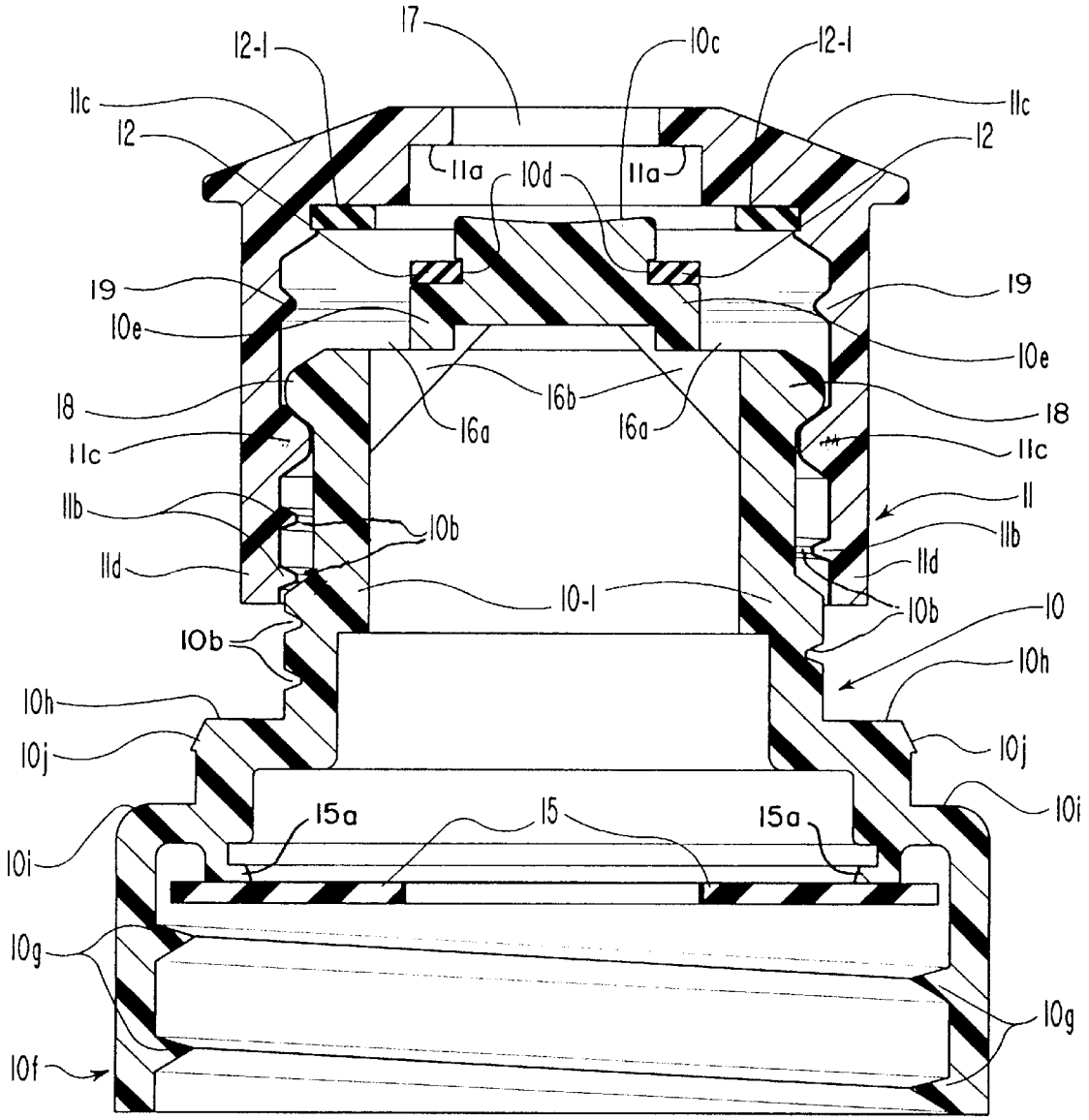
Figure 5:
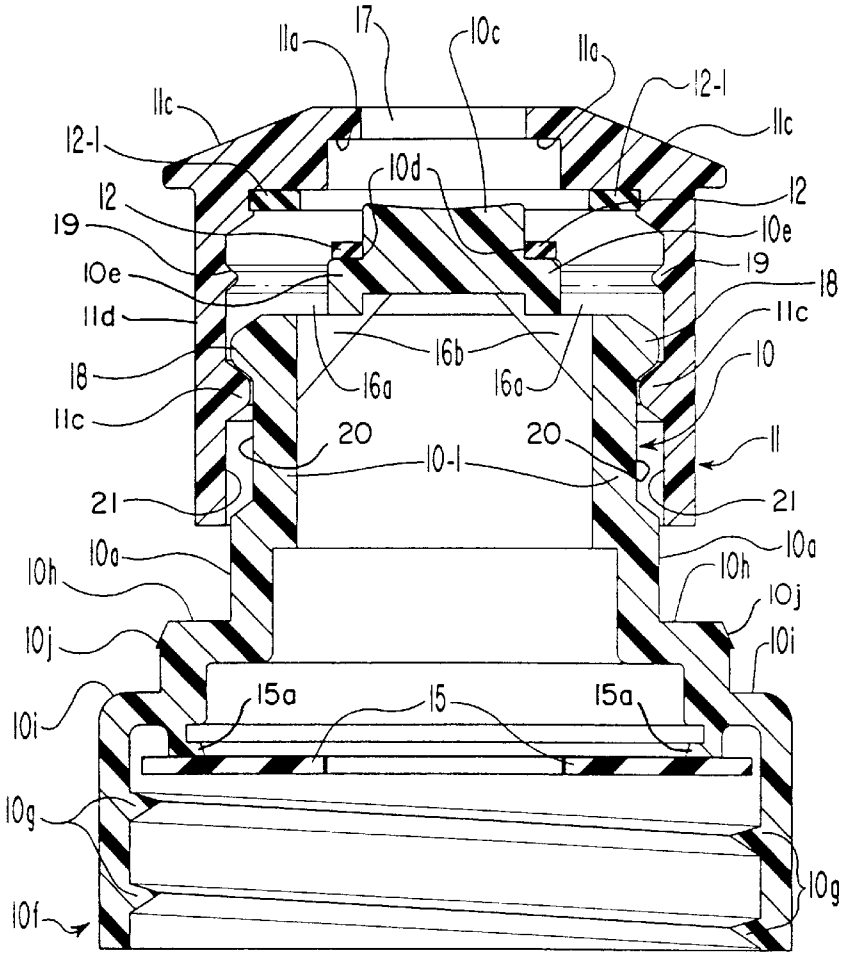

The typical reclosable bottle closure of the prior art has stationary and movable closure members largely corresponding to those identified in several embodiments of this invention as 10 and 11, respectively, but with the movable closure member 11 slidable upwardly and downwardly along the longitudinal pouring axis of the bottle closure on and relatively to a cylindrical intermediate portion 10*a* of the stationary closure member 10, as in the FIG. 5 embodiment of the present invention. In accordance with one aspect of the present invention, however, the prior art is modified by replacing the usual lower slideways on the mutually confronting, cylindrical faces of such closure members (which slideways may, less desirably, still be used as shown at 20 and 21 in the embodiment of FIG. 5) with mutually engaging, screw-threads 11*b* and screw valleys 10*b* on such confronting faces, as in the embodiments of FIGS. 1–4 and 6–8.

Thus, in the embodiments of FIGS. 1–4 and 6–8 the lower part of the outer face of the cylindrical intermediate portion 10*a* of stationary closure member 10 is provided with screw threads 10*b* extending upwardly from the lower end of such intermediate portion 10*a* by a distance somewhat more than the vertical distance that movable closure member 11 must travel downwardly relative to stationary closure member 10 to contact and sealingly compress fluid sealing members that are provided to achieve the principal purpose of the invention. In the embodiments of FIGS. 1 through 6, such fluid sealing members are in the form of sealing rings 12 and 12-1 of substantially flat disc washer formation, attached, in the embodiment of FIGS. 1–3, to the underside of movable closure member 11, and in FIG. 4 to the central stopper post 10*c* of the cylindrical intermediate portion 10*a* of stationary closure member 10 and to the underside of movable closure member 11, respectively, for effectively resealing a bottle 13 after it is initially opened for drinking or pouring a portion of liquid contents 14 therefrom.

Equipped with fluid sealing members 12 and 12-1 in accordance with this invention, bottle 13 may be effectively used for carbonated drinks and other drinks containing a gaseous constituent that would escape from similar bottles as presently used for ordinary drinking water and uncarbonated soft drinks.

As illustrated in FIG. 4, annular sealing ring 12 is fastened to the central stopper post 10*c* of stationary closure member 10 for being sealingly pressed by an overhanging annular seat 11*a* of movable closure member 11 when such closure member 11 is moved downwardly on and relative to stationary closure member 10 by screwing such movable closure member downwardly on the interengaging threads

11*b* and thread valleys 10*b*. For sealing ring fastening purposes, central stopper post upper portion 10*c* is modified from what it is in the prior art by undercutting to provide an annular sealing-ring-receiving recess 10*d*, above a larger diameter base 10*e*. The portion of such stopper post which overhangs such recess 10*d*, see FIG. 4, serves to retain sealing ring 12 in place. To enable sealing ring 12 to be positioned in recess 10*d*, it should be made of an elastic material, such as rubber or a flexible and resilient plastic.

Figure 2:
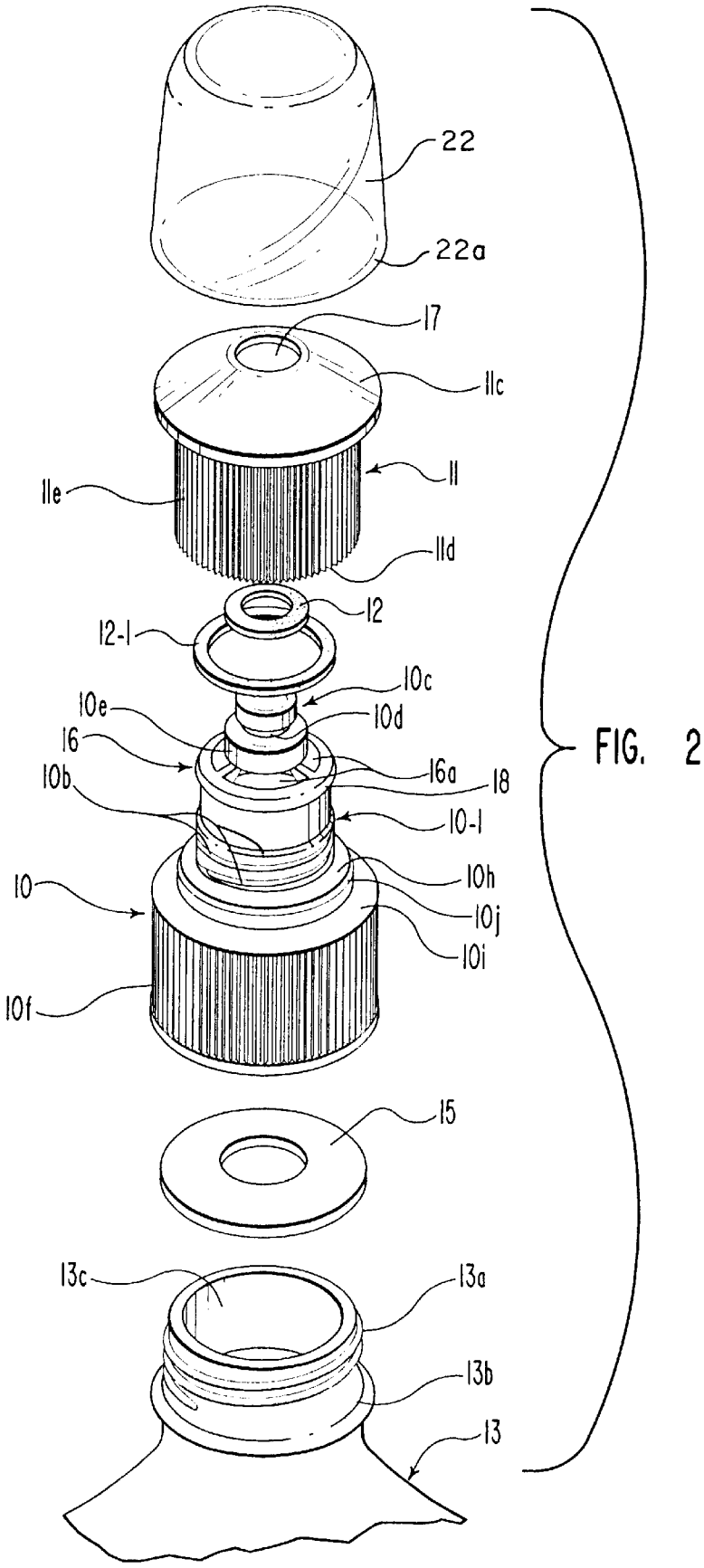
Figure 3:
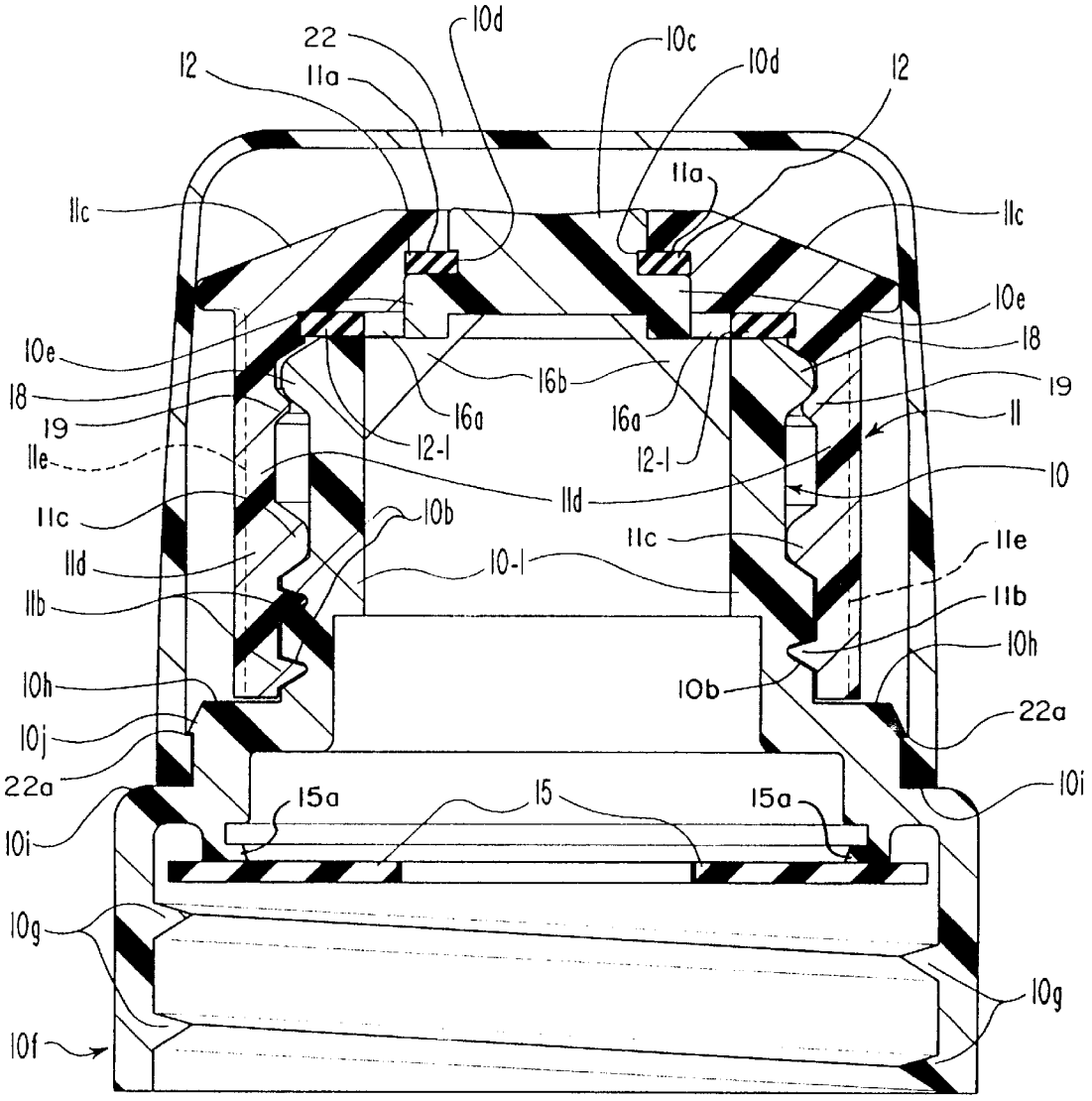

As in the prior art, the lower portion 10*f* of stationary closure member 10 is formed as a bottle cap, FIGS. 3 and 4, with internal threads 10*g* for screwing tightly onto external threads 13*a*, see especially FIG. 2, of the neck 13*b*, of bottle 13, so that the usual sealing washer 15 will be pressed against annular seat 15*a* when the bottle closure is applied to the bottle.

In both the prior art and the present improvement thereof, between stopper post portion 10*e*, FIG. 2, and cylindrical intermedial portion 10*a* of stationary closure member 10 is a spider 16 that provides dispensing openings 16*a* that are directed from entry to discharge therefrom along the pouring axis of the bottle closure and through which portions of the liquid contents 14 of bottle 13 flow as the bottle is opened from time-to-time, by moving movable closure member 11 upwardly relative to stationary closure member 10, as in FIG. 4, and is tipped for drinking or pouring. Spider 16 is rigid extending transversely between and circumferentially of cylindrical intermediate portion 10*a* and stopper post 10*c* of stationary closure member 10, as by being formed integrally therewith in the molding of stationary closure member 10 from a suitable plastic material.

A circumferential skirt portion 11*c* of movable closure member 11 surrounds cylindrical intermediate portion 10*a* of stationary closure member 10, being provided with the screw threads 11*b* on its interior surface. The confronting outer surface of cylindrical intermediate portion 10*a* of closure member 10 is provided with the screw thread valleys 10*b*, so movable closure portion 11 is movable upwardly and downwardly on stationary closure portion 10 by screwing action. Movable closure member 11 has a dispensing opening 17, FIG. 4, formed in its otherwise closed top 11*d* as the ultimate opening through which the liquid contents 14 of bottle 13 are dispensed.

Figure 1:
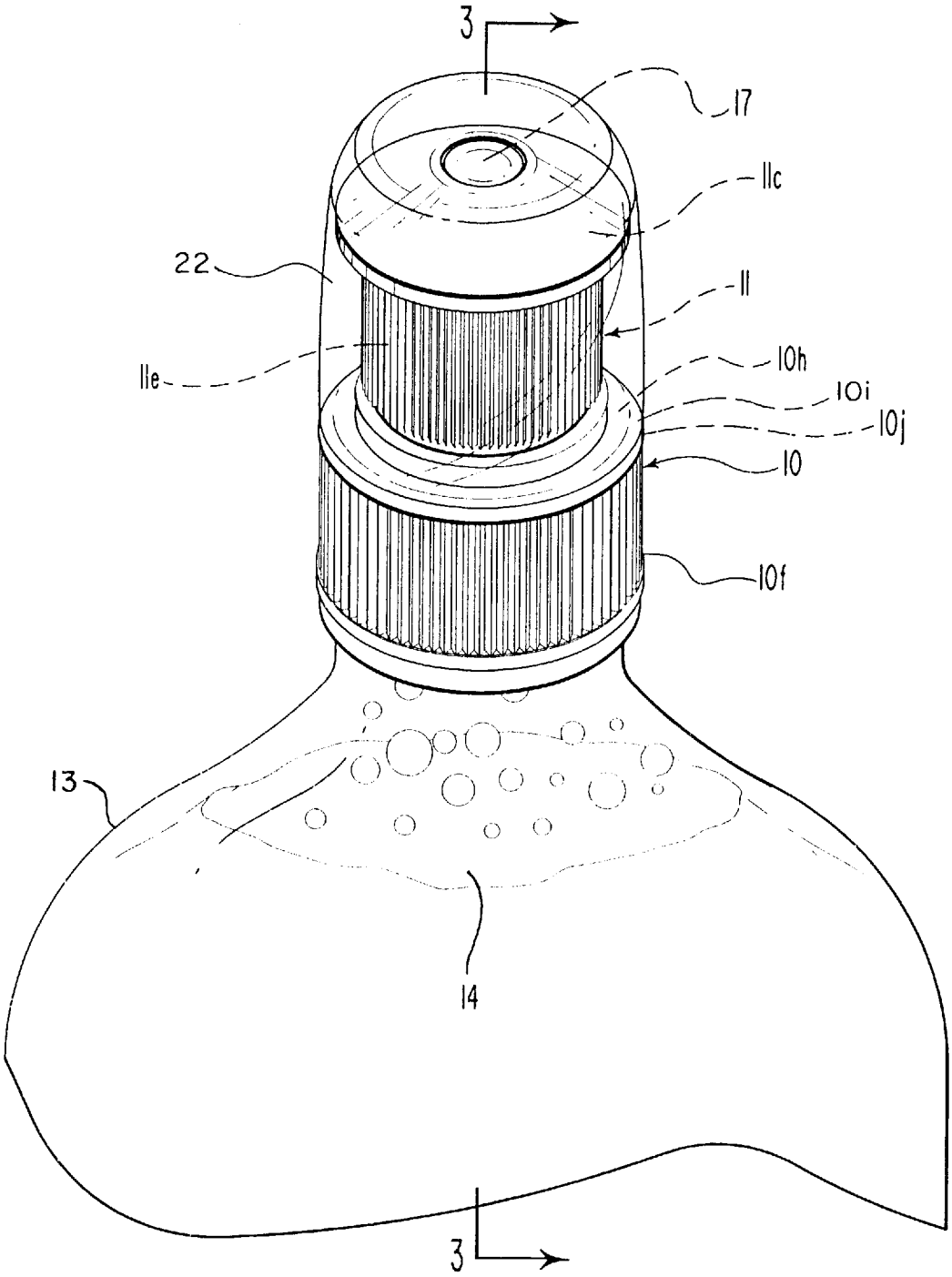

When movable closure member 11 is turned in one direction relative to stationary closure member 10, which direction depends upon the orientation of screw threads 10*b* and 11*b*, it is moved upwardly from the closed position of FIGS. 1 and 3, in which annular seat 11*a* is tightly and sealingly pressed downwardly against its coacting sealing ring 12 and sealing ring 12-1 is tightly and sealingly pressed downwardly against its coacting seat 10*g*, to the open position of FIG. 4. In such open position, liquid 14 may be poured from bottle 13 through dispensing opening 17 flowing first through openings 16*a* of spider 16.

As in the prior art, the lower cap portion 10*f* of stationary closure member 10 is shown shouldered at 10*h* and 10*i*, the former providing an annular step, which serves, as in the prior art, to receive the bottom of skirt 11*c*, the confronting upper slideways being provided with annular, snap-acting retainers 18 and 19, respectively, as shown in FIG. 3 for holding movable closure member 11 in its down position relative to stationary closure member 10. This serves to retain the bottle closure closed, with sealing ring 12 sealingly compressed.

As can be seen in FIGS. 1 through 4, the lower end of movable closure member 11 is spaced somewhat above step 10*h* in the embodiment of those Figs. to provide for sealing-ring-compression travel of movable closure member 11 relative to stationary closure member 10 in repeated reclosings of bottle 13 after being initially opened.

In both of the embodiments of FIGS. 1–4 and FIG. 5, lower annular step 10*i* serves to receive the lower end of a cover 22, FIGS. 1–3, when snapped into place over closure members 10 and 11. An integral, circular snap groove 22*a* is provided interiorly of the lower end of such cover 22 for engaging, by snap action, and external circular projection 10*j*, FIGS. 7 and 8, that is provided on stationary closure member 10 just below upper step 10*h* thereof.

For aiding in the manual screwing of movable closure member 11 relative to stationary closure member 10, the outer surface of skirt 11*c* is desirably closely ribbed as at 11*e*.

Figure 6:
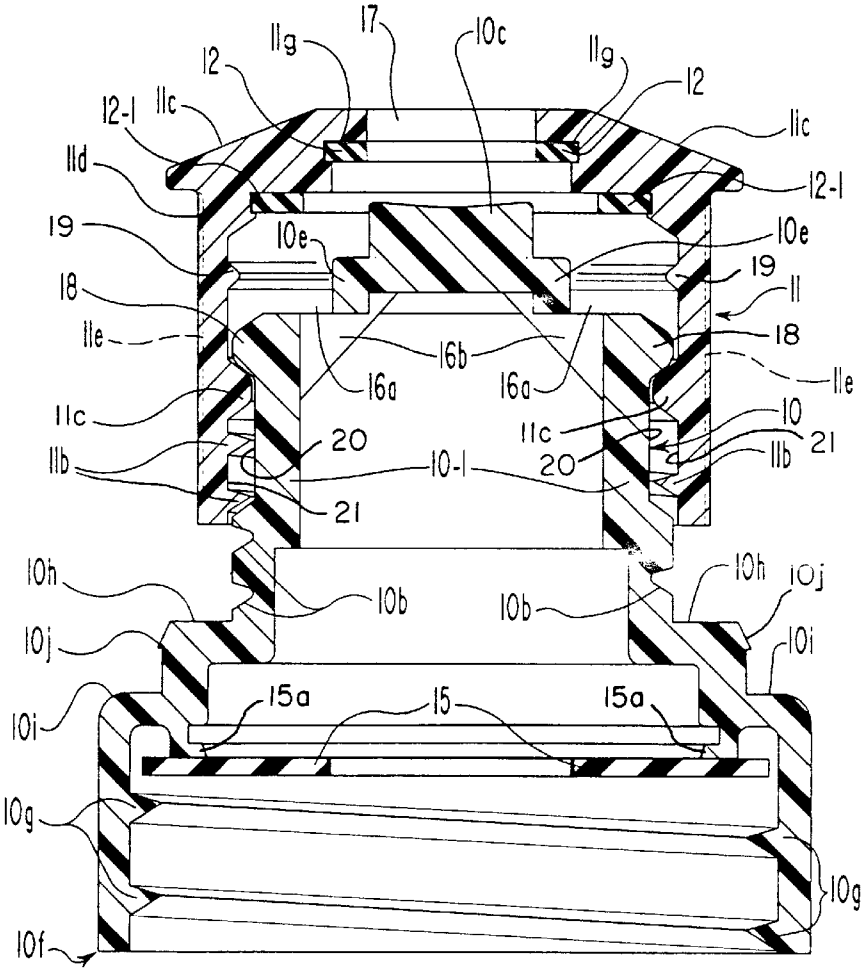

The embodiment of FIG. 6 corresponds to that of FIGS. 1–4, but the sealing ring 12 is mounted in movable closure member 11, instead of in stationary closure member 10 as it is in FIG. 5, within a re-entrant recess 11*y* therein that replaces seat 11*a*. Here, sealing ring 12 as so mounted seats against the top of annular shoulder 10*e* provided by the stopper post portion.

Figure 8:
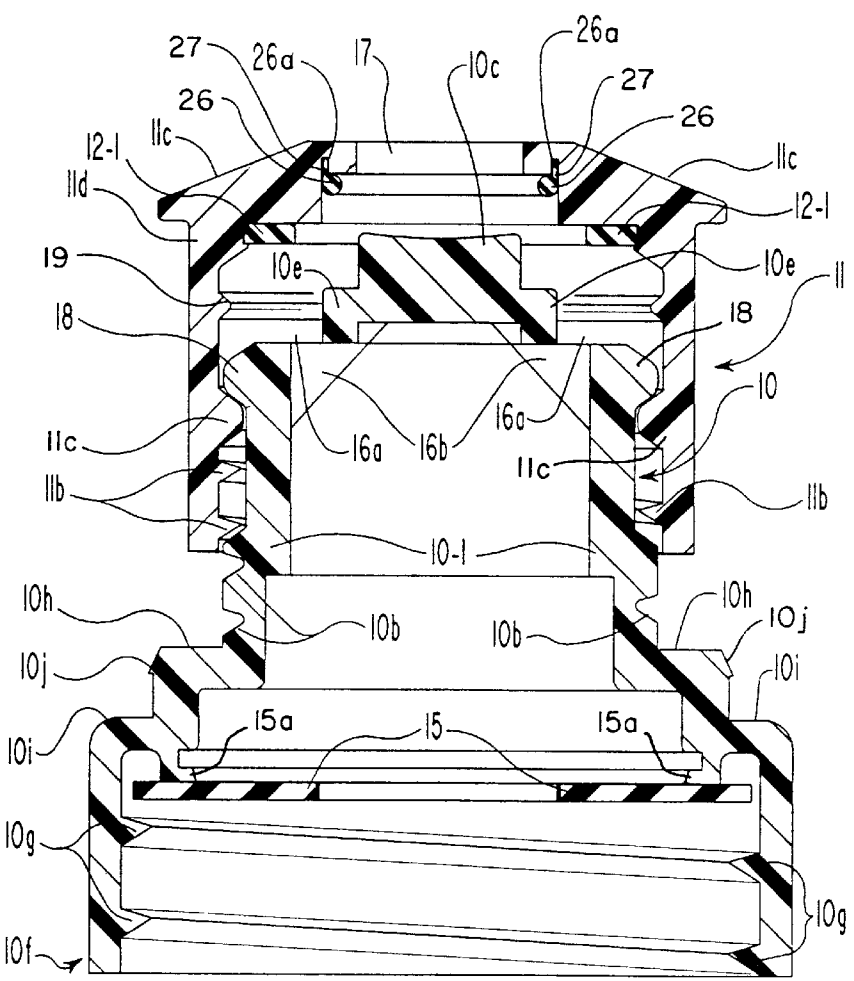
Figure 7:
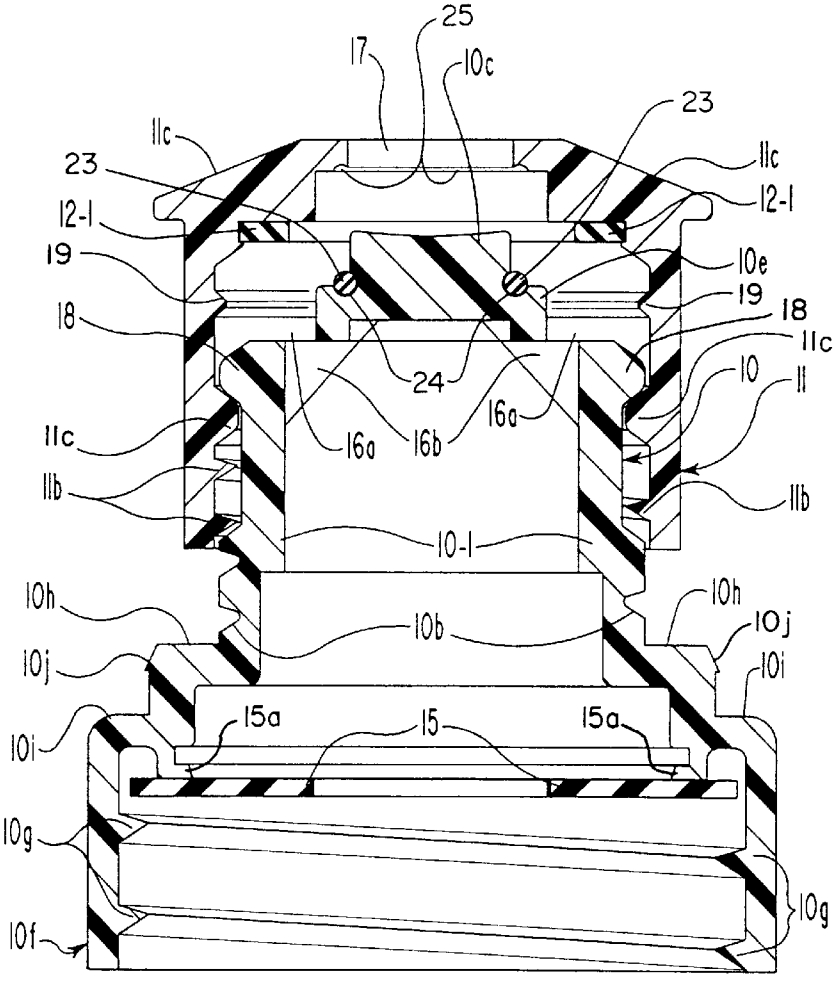

The embodiments of FIGS. 7 and 8 correspond with those of FIGS. 3 and 6, respectively, except that the sealing rings 12 of FIGS. 3 and 6 are replaced by O-rings, e.g., an O-ring 23 in the embodiment of FIG. 7 that is held in place by being fitted into an annular receiving groove 24 formed in the top of base 10*e* of the stopper post for seating coaction with a corresponding seating groove 25 in the underside of top 11*c* of movable closure member 11, replacing seat 11*a*, FIG. 3, and e.g., an O-ring 26 in the embodiment of FIG. 8 that is held in place on the underside of top 11*c* of movable closure member 11 by an upstanding circular flange 26*a* thereof inserted in a corresponding receiving groove 27 extending upwardly from the underside of top 11*c*. O-ring 26 seats against the flat top of base 10*e* when movable closure member 11 is screwed downwardly into bottle closure position.

Both sets of sealing ring members could be O-rings as shown in FIGS. 7 and 8 but are preferably of flat disc washer formation as in FIGS. 3–6 to take full advantage of the confronting flat annular seats.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A closure for bottles intended to hold a carbonated beverage or other beverage containing a gaseous constituent, said closure being adapted for momentarily opening the bottle to obtain a drink and for then reclosing the bottle to protect the contents against dissipation of the gaseous constituent of the beverage contained by the bottle, said bottle closure comprising cooperative closure members extending along the pouring axis of the bottle closure, one of said closure members being stationary relative to the other when applied to a bottle; said one, stationary closure member being formed for screwing onto and sealing against an externally threaded, pouring top of the bottle to which it is to be applied, and having a normally upper, stopper post portion with a closed top, intermediate and normally lower cylindrical portions, respectively, and a portion of spider formation rigidly connecting said stopper post portion with said cylindrical portions, said spider portion extending transversely of said pouring axis between said stopper post portion and said cylindrical portions and having liquid dispensing openings arranged circumferentially of said stopper post portion and of said cylindrical portions and directed from entry thereof to discharge therefrom along said pouring axis of the bottle closure; said other of the closure members being movable axially of the bottle closure relative to the said one, stationary closure member for opening and reclosing the bottle with which the bottle closure is used; a compression seat associated with one or the other of said closure members for coacting with a sealing ring member, said seat surrounding said stopper post portion circumferentially thereof and extending transversely of the pouring axis of the bottle closure; a sealing ring member operationally associated with one or the other of said closure member but separable therefrom and extending transversely of said pouring axis for compressively bearing against said compression seat when the bottle closure is in closed condition for tight sealing action therewith against escape therethrough of the gaseous constituent of a beverage contained by said bottle; said other, movable closure member circumferentially encircling said cylindrical portion of said stationary closure member; a second compression seat associated with one or the other of said closure member for a second sealing ring member and extending transversely of said pouring axis of the bottle closure; and a second sealing ring member operatively associated with one or the other of said closure member but separable therefrom and extending transversely of said pouring axis of the bottle closure for compressively bearing against said second compression seat when the bottle closure is in closed condition for tight sealing therewith against escape therethrough of the gaseous constituent of a beverage contained by said bottle when the bottle closure is in closed condition relative to said bottle.

2. A bottle closure according to claim 1, wherein the sealing ring members are inset into the closure members with which they are associated so as to be held thereby against displacement.

3. A bottle closure according to claim 2, wherein the sealing ring members include at least one substantially flat disc washer.

4. A bottle closure according to claim 2, wherein the sealing ring members include at least one O-ring.

5. A bottle closure according to claim 1, wherein the cylindrical portion of the one closure member and the encircling other closure member have confronting faces with interengaging screw threads arranged for moving said other closure member axially relative to said one closure member when turned in one direction and for moving said other closure member axially relative to said one closure member, thereby sealing a bottle to which said closure is applied against loss of fluid constituent of liquid held by the bottle, when turned in the opposite direction.

6. A bottle closure according to claim 5, wherein the other closure member has an outer surface that is serrated as finger gripping means to facilitate turning of said other closure member relative to the one closure member.

7. A bottle closure according to claim 1, wherein the sealing ring members are inset into retaining recesses of the closure members with which they are associated so as to be held thereby against displacement.

8. A closure member according to claim 5, wherein the sealing ring members include at least one substantially flat disc washer.

9. A bottle closure member according to claim 6, wherein the sealing ring members are of at least one O-ring.

10. A bottle closure according to claim 1, wherein the movable closure member threadedly engages the stationary member so as to be screwable upwardly and downwardly thereon.

* * * * *